US010633071B2

(12) United States Patent
Hasegawa

(10) Patent No.: US 10,633,071 B2
(45) Date of Patent: Apr. 28, 2020

(54) OUTBOARD MOTOR

(71) Applicant: YAMAHA HATSUDOKI KABUSHIKI KAISHA, Iwata-shi, Shizuoka (JP)

(72) Inventor: Hiroyuki Hasegawa, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/897,227

(22) Filed: Feb. 15, 2018

(65) Prior Publication Data

US 2019/0002072 A1 Jan. 3, 2019

(30) Foreign Application Priority Data

Jun. 30, 2017 (JP) ..... 2017-129328

(51) Int. Cl.
*B63H 20/32* (2006.01)
*F02B 61/04* (2006.01)

(52) U.S. Cl.
CPC ..... *B63H 20/32* (2013.01); *F02B 61/045* (2013.01)

(58) Field of Classification Search
CPC ..... B63H 20/32; F02M 35/167
See application file for complete search history.

(56) References Cited

U.S. PATENT DOCUMENTS 5,803,777 A 9/1998 Hiraoka
9,580,947 B1 * 2/2017 Amerling ..... E05C 19/12

FOREIGN PATENT DOCUMENTS

JP 08-268384 A 10/1996

* cited by examiner

*Primary Examiner* — Andrew Polay
(74) *Attorney, Agent, or Firm* — Keating and Bennett, LLP

(57) ABSTRACT

A cowl includes a bottom cowl, a top cowl, and a clamp device. The bottom cowl opens upward. The top cowl opens downward and closes an opening of the bottom cowl. The clamp device detachably couples the top cowl to the bottom cowl. The clamp device includes a clamp and an operating lever that operates the clamp. The clamp is disposed inside the cowl. The operating lever is disposed outside the cowl. A mating portion between the bottom cowl and the top cowl includes a first mating section and a second mating section as seen in a side view of the cowl. The first mating section extends rearward from a front end portion of the cowl. The second mating section extends upward and rearward from a rear end of the first mating section. The operating lever is located above an extension line defined by extending the first mating section rearward as seen in the side view of the cowl.

26 Claims, 7 Drawing Sheets

OUTBOARD MOTOR

CROSS REFERENCE TO RELATED APPLICATIONS

This application claims the benefit of priority to Japanese Patent Application No. 2017-129328 filed on Jun. 30, 2017. The entire contents of this application are hereby incorporated herein by reference.

BACKGROUND OF THE INVENTION

1. Field of the Invention

The present invention relates to an outboard motor.

2. Description of the Related Art

There has been conventionally known a type of cowl for accommodating an engine of an outboard motor, which includes a bottom cowl, a top cowl and a clamp by which the bottom cowl and the top cowl are detachably coupled to each other (see Japan Laid-open Patent Application Publication No. H08-268384).

The clamp includes an operating lever disposed on a rear end portion of the cowl.

In the cowl described in Japan Laid-open Patent Application Publication No. H08-268384, a mating portion between the bottom cowl and the top cowl entirely extends in a horizontal direction, and the operating lever is disposed below the mating portion.

However, it is not easy for a worker, standing in front of the cowl, to operate the operating lever disposed on the rear end portion of the cowl to perform attachment/detachment work of the top cowl, and besides, it is not easy to move the top cowl, which is a heavy object.

SUMMARY OF THE INVENTION

Preferred embodiments of the present invention provide outboard motors to and from which a top cowl is easily attachable and detachable.

An outboard motor according to a preferred embodiment of the present invention includes an engine and a cowl housing the engine. The cowl includes a bottom cowl, a top cowl, and a clamp device. The bottom cowl opens upward. The top cowl opens downward and closes an opening of the bottom cowl. The clamp device detachably couples the top cowl to the bottom cowl. The clamp device includes a clamp and an operating lever. The clamp device is disposed inside the cowl. The operating lever operates the clamp and is disposed outside the cowl. A mating portion between the bottom cowl and the top cowl includes a first mating section and a second mating section as seen in a side view of the cowl. The first mating section extends rearward from a front end portion of the cowl. The second mating section extends upward and rearward from a rear end of the first mating section. The operating lever is located above an extension line defined by extending the first mating section rearward as seen in the side view of the cowl.

According to preferred embodiments of the present invention, it is possible to provide outboard motors to and from which a top cowl is easily attachable and detachable.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
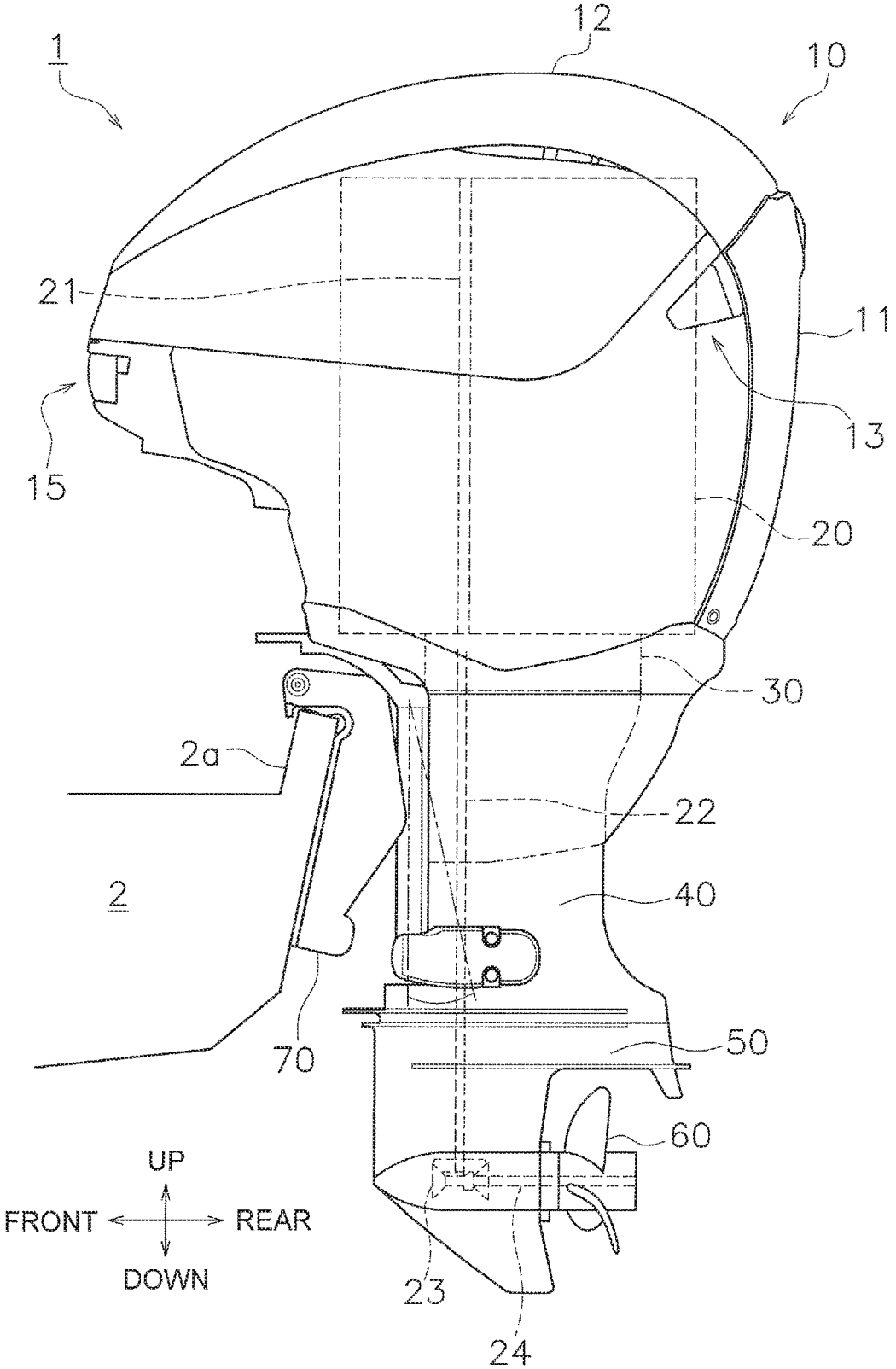
FIG. 1 is a left side view of an outboard motor.
Figure 2:
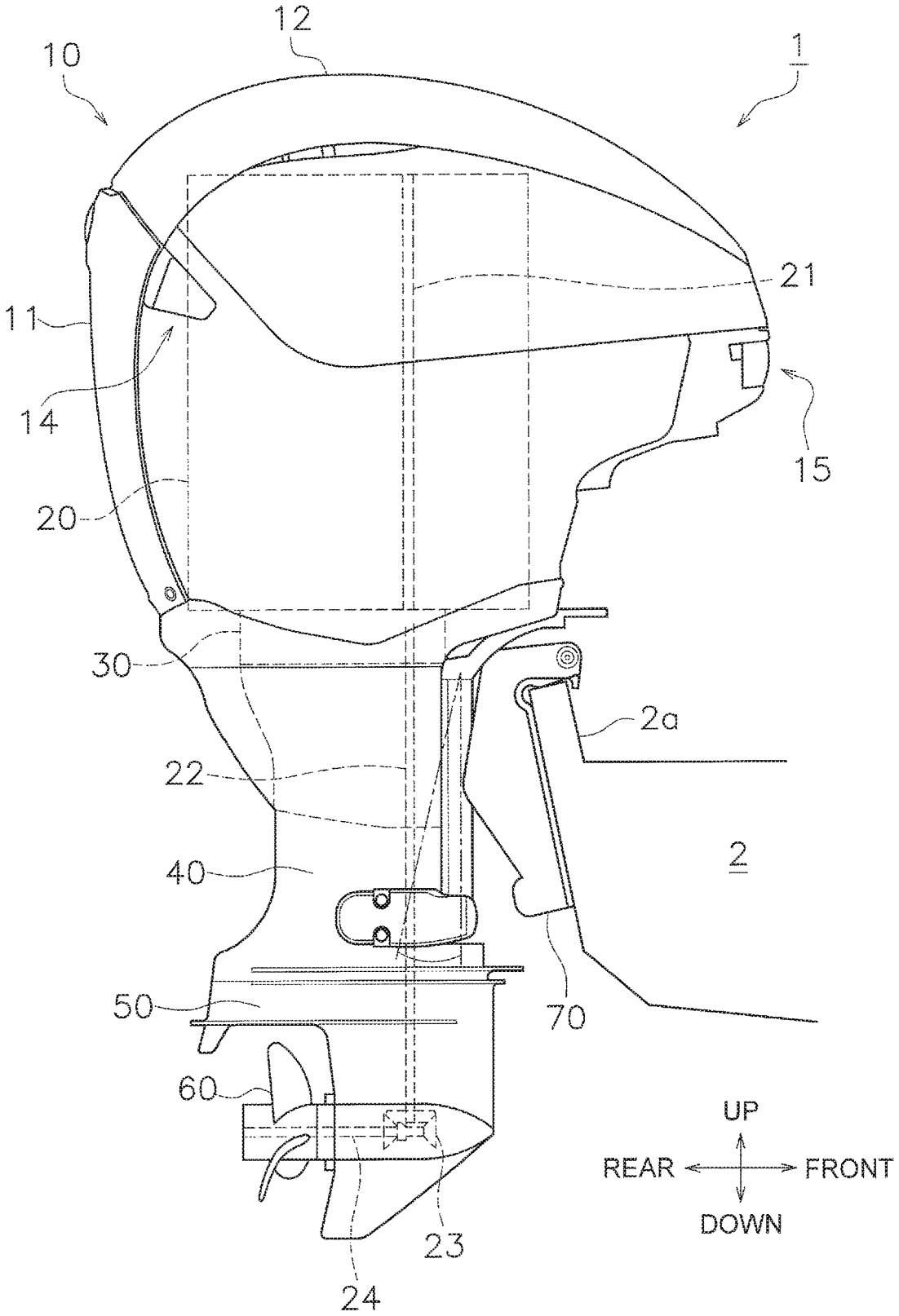
FIG. 2 is a right side view of the outboard motor.

An outboard motor according to preferred embodiments of the present invention will be hereinafter explained with reference to drawings. FIG. 1 is a left side view of an outboard motor 1, whereas FIG. 2 is a right side view of the outboard motor 1.

In the present specification, a side of the outboard motor directed toward a vessel body will be referred to as the "front", whereas a side of the outboard motor directed away from the vessel body will be referred to as the "rear". In the present specification, the terms "up" and "down" are defined with reference to a vertical direction, whereas the terms "right" and "left" are defined with reference to a traveling direction during forward movement of the vessel body.

The outboard motor 1 is attached to the stern of a vessel body 2. The outboard motor 1 includes a cowl 10, an engine 20, an exhaust guide 30, an upper case 40, a lower case 50, a propeller 60, and a clamp bracket 70.

The cowl 10 is disposed on an upper end portion of the outboard motor 1. The cowl 10 houses the engine 20 in the interior thereof. The cowl 10 includes a bottom cowl 11, a top cowl 12, a left clamp device 13, a right clamp device 14, and a front clamp device 15. Each of the left and right clamp devices 13 and 14 is an example of a "clamp device".

The bottom cowl 11 surrounds the engine 20 from the lateral sides. The bottom cowl 11 opens upward. The bottom cowl 11 is attached to the exhaust guide 30. The top cowl 12 covers the engine 20 from above. The top cowl 12 is disposed on the bottom cowl 11. The top cowl 12 opens downward, and closes the opening of the bottom cowl 11. The left clamp device 13, the right clamp device 14, and the front clamp device 15 detachably couple the top cowl 12 to the bottom cowl 11. The structure of the cowl 10 will be described below.

The engine 20 is preferably an internal combustion engine that burns fuel to generate a driving force. The engine 20 is housed in the interior of the cowl 10. The engine 20 is mounted on the exhaust guide 30. The engine 20 includes a crankshaft 21 extending in the vertical direction.

The exhaust guide 30 is coupled to the clamp bracket 70. The exhaust guide 30 supports the engine 20. The bottom cowl 11 and the upper case 40 are attached to the exhaust guide 30.

The upper case 40 is disposed directly below the bottom cowl 11. The upper case 40 is attached to the exhaust guide 30. The lower case 50 is disposed directly below the upper case 40. The lower case 50 is attached to a lower end portion of the upper case 40. The propeller 60 is attached to the lower case 50.

The propeller 60 is rotated by the driving force of the engine 20. The driving force of the engine 20 is transmitted to the propeller 60 through the crankshaft 21, a drive shaft 22, a bevel gear 23, and a propeller shaft 24.

The clamp bracket 70 is attached to a transom 2*a* of the vessel body 2. The outboard motor 1 is supported by the clamp bracket 70 so as to be steerable and tiltable.

Figure 3:
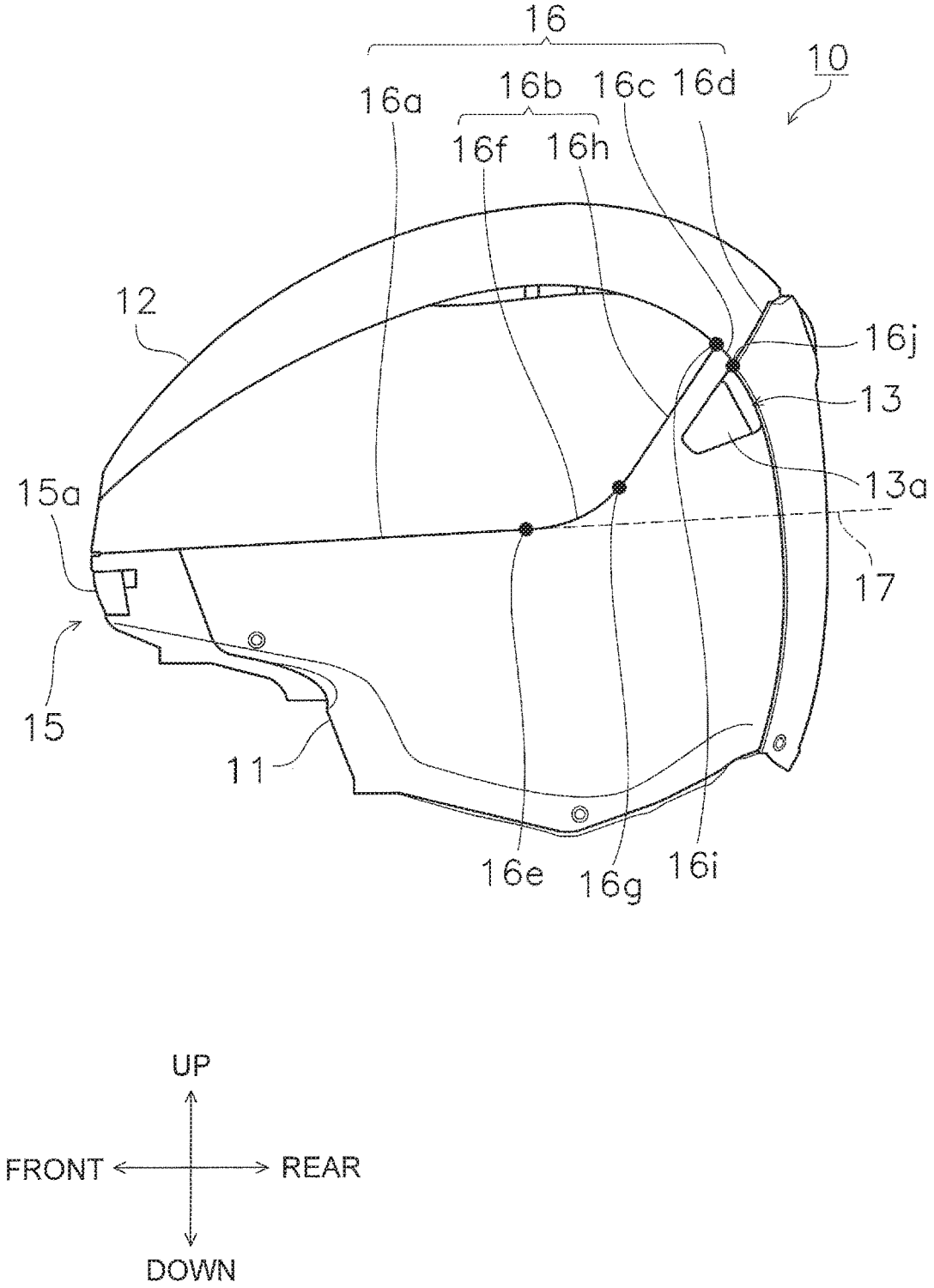
FIG. 3 is a left side view of a cowl.
Figure 4:
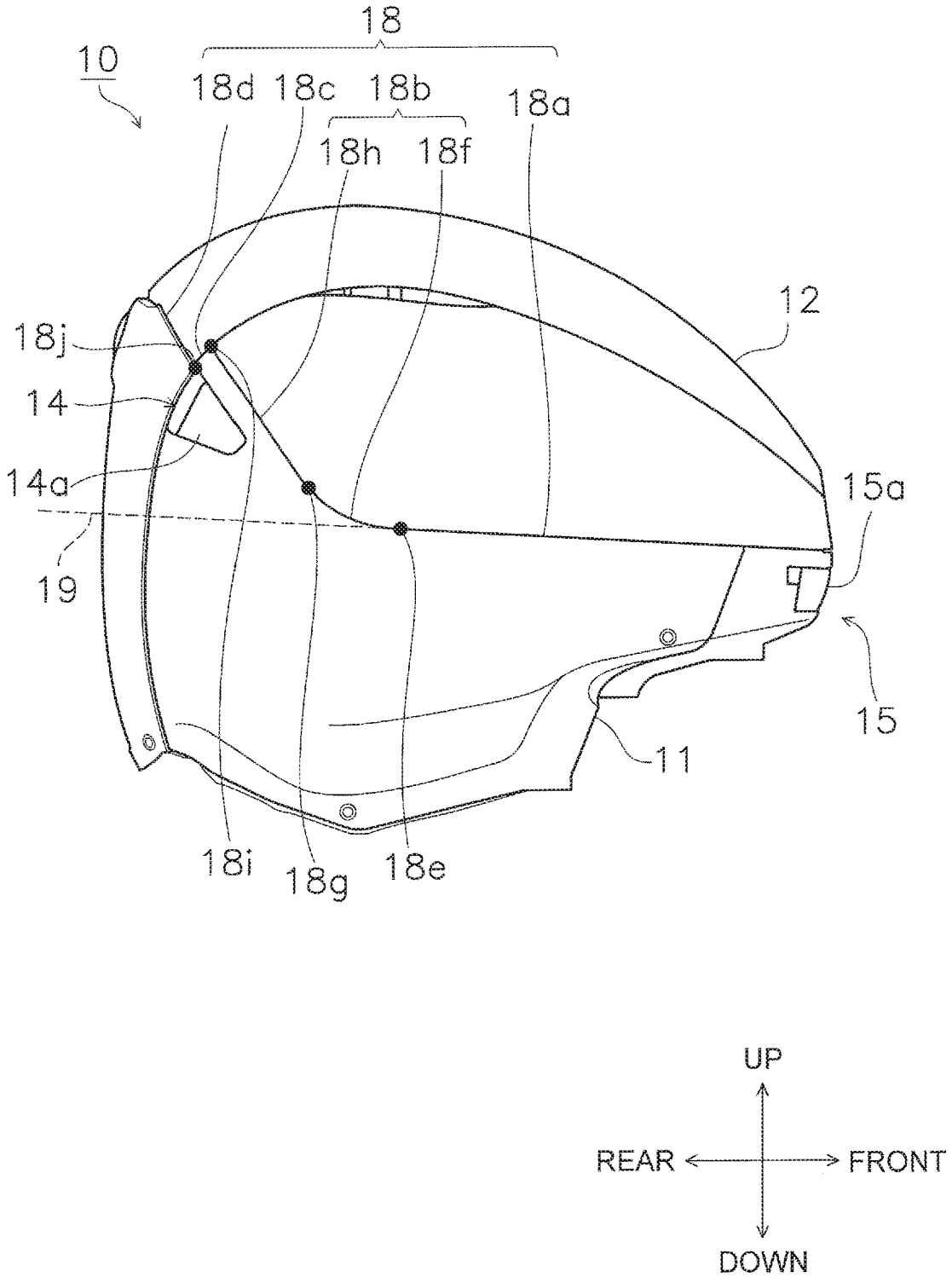
FIG. 4 is a right side view of the cowl.

Next, the structure of the cowl 10 will be explained with reference to the drawings. FIG. 3 is a left side view of the cowl 10. FIG. 4 is a right side view of the cowl 10.

As shown in FIG. 3, in the left side view of the cowl 10, a mating portion 16 is located between the bottom cowl 11 and the top cowl 12. The mating portion 16 is a boundary region between the bottom cowl 11 and the top cowl 12. A gap may exist in at least a portion of the boundary region between the bottom cowl 11 and the top cowl 12.

The mating portion 16 includes a first mating section 16*a*, a second mating section 16*b*, a third mating section 16*c*, and a fourth mating section 16*d*. The mating portion 16 is an example of a "mating portion"; the first mating section 16*a* is an example of a "first mating section"; and the second mating section 16*b* is an example of a "second mating section".

The first mating section 16*a* extends rearward from a front end portion of the cowl 10. The expression "an object extends rearward" encompasses not only an object extending horizontally or substantially horizontally rearward without tilting but also an object extending rearward and tilting upward. When the first mating section 16*a* extends rearward and tilting upward, the angle of the first mating section 16*a* with respect to a horizontal direction is preferably less than that of a straight section 16*h* (to be described below) of the second mating section 16*b* with respect to the horizontal direction. More specifically, when the first mating section 16*a* extends upward and rearward, the angle of the first mating section 16*a* with respect to the horizontal direction is preferably less than or equal to about 60 degrees, for example. FIG. 3 shows a structure in which the first mating section 16*a* has a straight shape. However, at least a portion of the first mating section 16*a* may have a curved shape or a winding shape.

The second mating section 16*b* extends upward and rearward from a rear end 16*e* of the first mating section 16*a*. More specifically, the second mating section 16*b* includes a curved section 16*f* and the straight section 16*h*. The curved section 16*f* extends upward and rearward from the rear end 16*e* of the first mating section 16*a*. The straight section 16*h* extends upward and rearward from a rear end 16*g* of the curved section 16*f*. It should be noted that the second mating section 16*b* may have an entirely curved shape or an entirely straight shape.

The third mating section 16*c* extends downward and rearward from a rear end 16*i* of the second mating section 16*b*. The fourth mating section 16*d* extends upward and rearward from a rear end 16*j* of the third mating section 16*c*. The fourth mating section 16*d* extends from the rear end 16*j* of the third mating section 16*c* to a rear end portion of the cowl 10. It should be noted that the mating portion 16 may not include the third mating section 16*c*. In this case, the fourth mating section 16*d* may extend upward and rearward from the rear end 16*i* of the second mating section 16*b*.

The left clamp device 13 includes a left operating lever 13*a*. The left operating lever 13*a* is disposed outside the cowl 10 (specifically, outside the bottom cowl 11). The left operating lever 13*a* is located above an extension line 17 defined by rearwardly extending the first mating section 16*a*. The extension line 17 extends horizontally or substantially horizontally rearward from the rear end 16*e* of the first mating section 16*a*. The left operating lever 13*a* is located in a region between the second mating section 16*b* and the extension line 17. A method of operating the left operating lever 13*a* will be described below.

As described above, the mating portion 16 tilts upward at the rear side thereof, such that the left operating lever 13*a* is disposed in a high position. Therefore, the top cowl 12 has a light weight. Additionally, it is easy for a worker, standing in front of the cowl 10, to operate the left operating lever 13*a* to attach and detach the top cowl 12.

As shown in FIG. 4, in the right side view of the cowl 10, a mating portion 18 is located between the bottom cowl 11 and the top cowl 12. The mating portion 18 is a boundary region between the bottom cowl 11 and the top cowl 12. A gap may exist in at least a portion of the boundary region between the bottom cowl 11 and the top cowl 12.

The mating portion 18 includes a first mating section 18*a*, a second mating section 18*b*, a third mating section 18*c*, and a fourth mating section 18*d*. The mating portion 18 is an example of a "mating portion"; the first mating section 18*a* is an example of a "first mating section"; and the second mating section 18*b* is an example of a "second mating section".

The first mating section 18*a* extends rearward from the front end portion of the cowl 10. FIG. 4 shows a structure in which the first mating section 18*a* has a straight shape. However, at least a portion of the first mating section 18*a* may have a curved shape or a winding shape. The first mating section 18*a* extends to the first mating section 16*a*, as shown in FIG. 3.

The second mating section 18*b* extends upward and rearward from a rear end 18*e* of the first mating section 18*a*. More specifically, the second mating section 18*b* includes a curved section 18*f* and a straight section 18*h*. The curved section 18*f* extends upward and rearward from the rear end 18*e* of the first mating section 18*a*. The straight section 18*h* extends upward and rearward from a rear end 18*g* of the curved section 18*f*. It should be noted that the second mating section 18*b* may have an entirely curved shape or an entirely straight shape.

The third mating section 18*c* extends downward and rearward from a rear end 18*i* of the second mating section 18*b*. The fourth mating section 18*d* extends upward and rearward from a rear end 18*j* of the third mating section 18*c*. The fourth mating section 18*d* extends from the rear end 18*j* of the third mating section 18*c* to the rear end portion of the cowl 10. It should be noted that the mating portion 18 may not include the third mating section 18*c*. In this case, the fourth mating section 18*d* may extend upward and rearward from the rear end 18*i* of the second mating section 18*b*.

The right clamp device 14 includes a right operating lever 14*a*. The right operating lever 14*a* is disposed outside the cowl 10 (specifically, outside the bottom cowl 11). The right operating lever 14*a* is located above an extension line 19 defined by rearwardly extending the first mating section 18*a*. The extension line 19 extends horizontally or substantially horizontally rearward from the rear end 18*e* of the first mating section 18*a*. The right operating lever 14*a* is located in a region between the second mating section 18*b* and the extension line 19. The right operating lever 14*a* is disposed on the opposite side of the left operating lever 13*a* with reference to a center line of the cowl 10 in the right-and-left direction. The right operating lever 14*a* is preferably disposed in a symmetric position to the left operating lever 13*a* with reference to the center line of the cowl 10 in the right-and-left direction.

As described above, the mating portion 18 tilts upward at the rear side thereof, such that the right operating lever 14*a* is disposed in a high position. Therefore, the top cowl 12 has a light weight. Additionally, it is easy for the worker, standing in front of the cowl 10, to operate the right operating lever 14*a* to attach and detach the top cowl 12.

As shown in FIGS. 3 and 4, the front clamp device 15 includes a front operating lever 15*a*. The front operating lever 15*a* is disposed outside the cowl 10 (specifically, outside the bottom cowl 11). The front operating lever 15*a* is located directly below the first mating section 16*a*. The front operating lever 15*a* is disposed on the front end portion of the cowl 10. Hence, it is easy for the worker, standing in front of the cowl 10, to operate the front operating lever 15*a* to attach and detach the top cowl 12.

Next, a structure of the left clamp device 13 will be explained with reference to the drawings. Preferably, the structure of the right clamp device 14 and the front clamp device 15 is similar to that of the left clamp device 13. Hence, the structure of the left clamp device 13 will be mainly explained in the present preferred embodiment.

Figure 5:
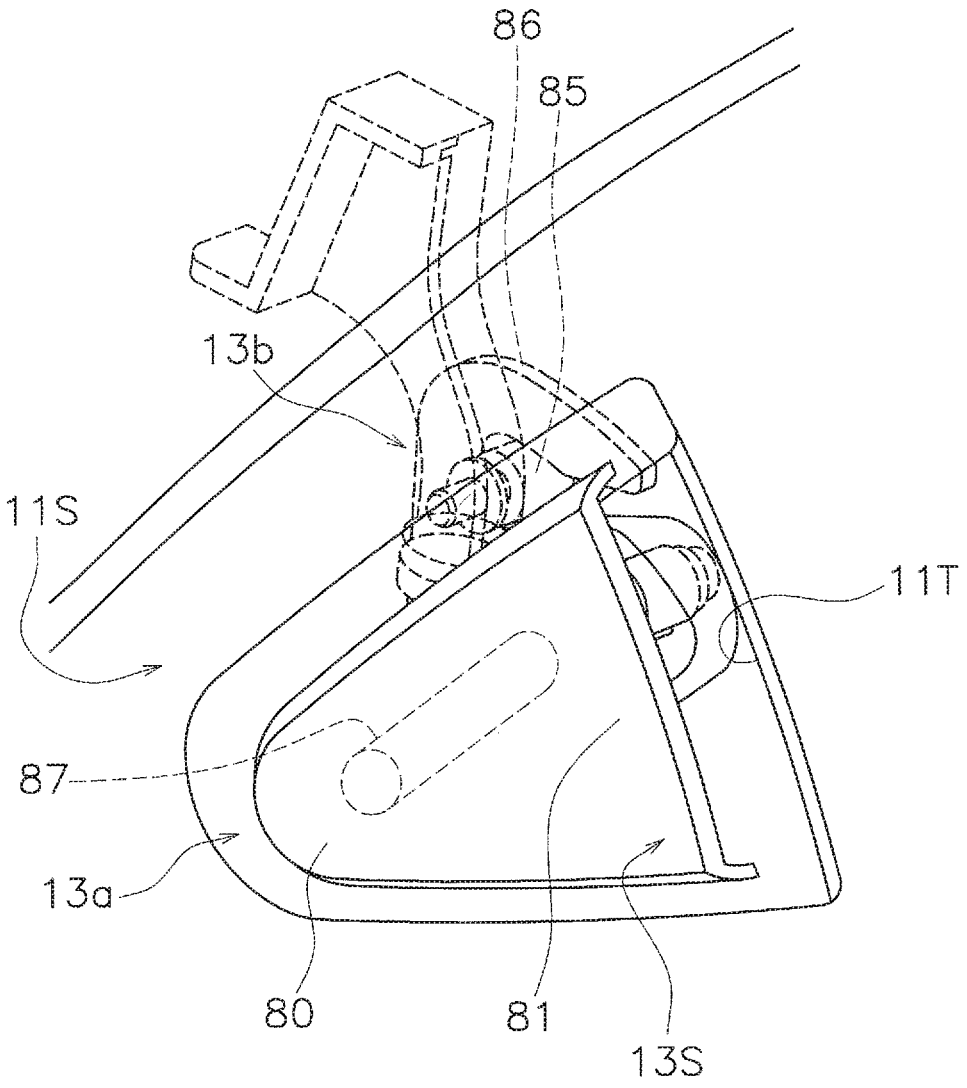
FIG. 5 is a schematic view of a left clamp device (in a housed position).
Figure 6:
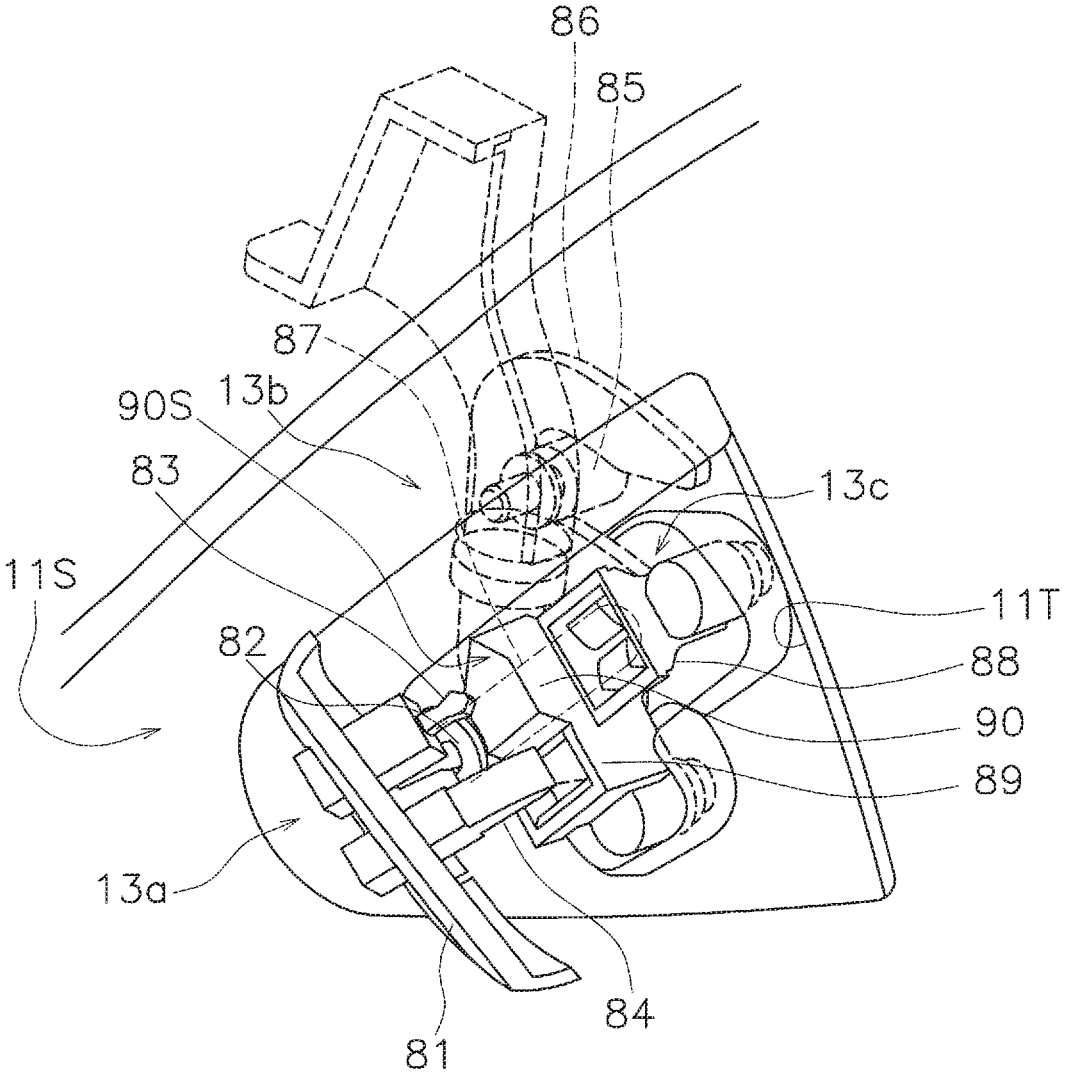
FIG. 6 is a schematic view of the left clamp device (in a protruded position).
Figure 7:
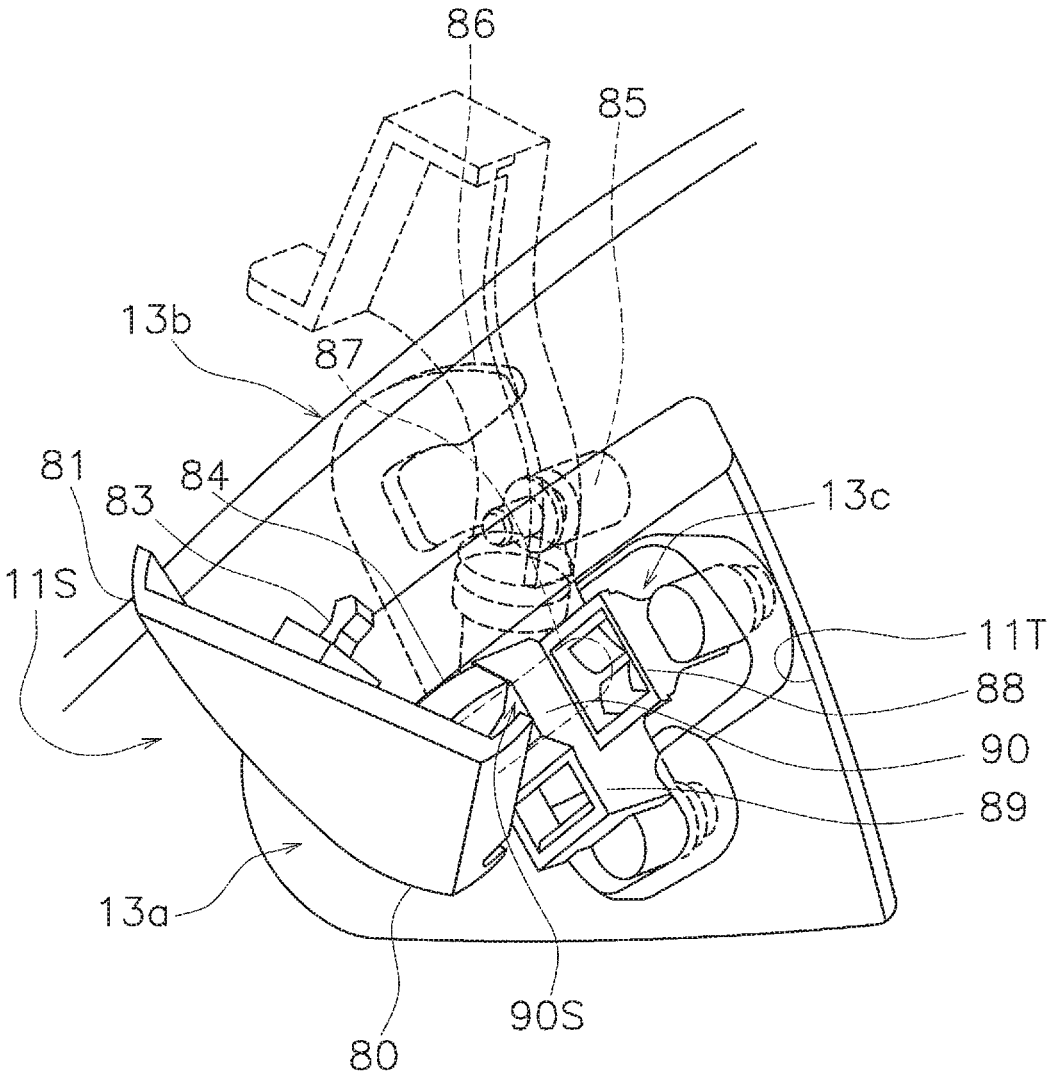
FIG. 7 is a schematic view of the left clamp device (in a released position).

FIGS. 5 to 7 are schematic views of the structure of the left clamp device 13. FIG. 5 shows the left operating lever 13*a* located in "a housed position"; FIG. 6 shows the left operating lever 13*a* located in "a protruded position"; and FIG. 7 shows the left operating lever 13*a* located in "a released position". In the present preferred embodiment, each of "the housed position" and "the protruded position" is an example of an "engaged position".

As shown in FIGS. 5 to 7, the left clamp device 13 includes the left operating lever 13*a*, a left clamp 13*b*, and a left support 13*c*. The left operating lever 13*a* is an example of an "operating lever", and the left clamp 13*b* is an example of a "clamp".

The left operating lever 13*a* operates the left clamp 13*b*. The left operating lever 13*a* includes a fixing portion 80, a holding portion 81, a pivot portion 82, a first protruding portion 83, and a second protruding portion 84.

The fixing portion 80 is attached to a turn shaft 87 of the left clamp 13*b* through the pivot portion 82. The holding portion 81 extends to the fixing portion 80. The holding portion 81 is a tab on which a worker operating the left operating lever 13*a* hooks his or her finger. The holding portion 81 is located rearward of the turn shaft 87. This structure makes it easy for the worker standing in front of the cowl 10 to hook his or her finger on the holding portion 81.

The pivot portion 82 is located inside the fixing portion 80. The pivot portion 82 is fixed to an outer end portion of the turn shaft 87. The pivot portion 82 supports the fixing portion 80 such that the fixing portion 80 is pivotable about an axis perpendicular to the turn shaft 87. With this structure, the left operating lever 13*a* is pivotable from the housed position to the protruded portion and vice versa.

The first protruding portion 83 is located inside the holding portion 81. The first protruding portion 83 protrudes from the holding portion 81 toward the left support 13*c*. When the left operating lever 13*a* is located in the housed position, the first protruding portion 83 is locked to a lock 88 of the left support 13*c*, such that the left operating lever 13*a* is held in the housed position. The first protruding portion 83 is released from the lock 88 when the left operating lever 13*a* is disposed in the protruded position (see FIG. 6) and when the left operating lever 13*a* is disposed in the released position (see FIG. 7).

The second protruding portion 84 is located inside the holding portion 81. The second protruding portion 84 protrudes from the holding portion 81 toward the left support 13*c*. When the left operating lever 13*a* is located in the housed position, the second protruding portion 84 is fitted to a fitting 89 of the left support 13*c*. The second protruding portion 84 is released from the fitting 89 when the left operating lever 13*a* is disposed in the protruded position (see FIG. 6) and when the left operating lever 13*a* is disposed in the released position (see FIG. 7).

The left clamp 13*b* is located inside the cowl 10 (specifically, inside the bottom cowl 11). The left clamp 13*b* includes a fixed member 85, an engaging member 86, and the turn shaft 87.

The fixed member 85 is fixed to the top cowl 12. When the top cowl 12 is attached to the bottom cowl 11, the fixed member 85 is located inside the bottom cowl 11. In FIGS. 5 to 7, the fixed member 85 is preferably rod-shaped or substantially rod-shaped. However, the fixed member 85 may have an arbitrary shape as long as the engaging member 86 is able to be engaged therewith.

The engaging member 86 is fixed to an inner end portion of the turn shaft 87. The engaging member 86 is turned together with the turn shaft 87. In the present preferred embodiment, the engaging member 86 is preferably plate-shaped or substantially plate-shaped. The engaging member 86 is disposed along the inner surface of the cowl 10 (specifically, the inner surface of the bottom cowl 11). Therefore, when the engaging member 86 is turned about the turn shaft 87, the engaging member 86 is moved along the inner surface of the bottom cowl 11. Consequently, it is possible to reduce a space required to turn the engaging member 86, and besides, to prevent the engaging member 86 from interfering with other members in the periphery thereof.

The turn shaft 87 is fixed to the bottom cowl 11 in a turnable state. The turn shaft 87 is inserted through an insertion through hole provided in the bottom cowl 11. A lubricant (e.g., grease, etc.) is filled in a gap between the turn shaft 87 and the insertion through hole. The pivot portion 82 of the left operating lever 13*a* is fixed to the outer end portion of the turn shaft 87. The engaging member 86 is fixed to the inner end portion of the turn shaft 87. The turn shaft 87 extends along the horizontal or substantially horizontal direction. With this structure, compared to a structure in which the turn shaft 87 extends longitudinally along the vertical direction, water is more reliably prevented from flowing along the turn shaft 87 and intruding into the interior of the cowl 10.

The left support 13*c* is disposed on a bottom portion of a recess 11T provided in the bottom cowl 11. The left support 13*c* includes the lock 88, the fitting 89, and a stopper 90. When the left operating lever 13*a* is located in the housed position, the first protruding portion 83 of the left operating lever 13*a* is locked to the lock 88, whereas the second protruding portion 84 of the left operating lever 13*a* is fitted to the fitting 89.

The stopper 90 is preferably disposed directly above the fitting 89. The stopper 90 includes a stopper surface 90S opposed to the holding portion 81. As shown in FIG. 7, when the left operating lever 13*a* is located in the released position, the second protruding portion 84 makes contact with the stopper surface 90S, such that the left operating lever 13*a* is supported by the left support 13*c*. With this structure, it is possible to prevent the left operating lever 13*a* from closing against the intention of a worker and the worker gets his or her finger trapped between the left operating lever 13*a* and the recess 11T.

Additionally, as shown in FIG. 7, when the left operating lever 13*a* is turned to the released position, the center of gravity of the left operating lever 13*a* is located above and forward of the turn shaft 87. With this structure, the left operating lever 13*a* is prevented, by the weight thereof, from returning to the protruded position shown in FIG. 5 against the intention of the worker. The position of the center of gravity of the left operating lever 13*a* is arbitrarily adjustable by, for instance, changing the weight of the second protruding portion 84.

As shown in FIG. 5, when the left operating lever 13*a* is located in the housed position, the engaging member 86 is engaged with the fixed member 85, such that the top cowl 12 is fixed to the bottom cowl 11. In this case, the left operating lever 13*a* is housed in the recess 11T provided on an outer surface 11S of the bottom cowl 11. The outer edge of the opening of the recess 11T extends along the outer edge of the left operating lever 13*a*. With this structure, the gap between the recess 11T and the left operating lever 13*a* is narrowed. Hence, water is more reliably prevented from intruding into the interior of the cowl 10 from the recess 11T. A portion of the outer edge of the opening of the recess 11T extends along the second mating section 16*b*. A gap, in which the worker puts his or her finger, is provided between the holding portion 81 of the left operating lever 13*a* and the recess 11T.

When the left operating lever 13*a* is housed in the recess 11T, an outer surface 13S of the left operating lever 13*a* is flush with the outer surface 11S of the bottom cowl 11. Therefore, compared to a structure in which the left operating lever 13*a* protrudes from the bottom cowl 11, the left operating lever 13*a* is prevented from being operated in a manner that is contrary to the intention of the worker.

As shown in FIG. 6, when the left operating lever 13*a* is located in the protruded position, the engaging member 86 is kept engaged with the fixed member 85, such that the top cowl 12 stays fixed to the bottom cowl 11.

As shown in FIG. 7, when the left operating lever 13*a* is located in the released position, the engaging member 86 is released from the fixed member 85, such that the top cowl 12 becomes detachable from the bottom cowl 11. The released position is located above the engaged position (the housed position and the protruded position).

Other Preferred Embodiments

Preferred embodiments of the present invention have been explained above. However, the present invention is not limited to the above-described preferred embodiments, and a variety of changes can be made without departing from the gist of the present invention.

For example, the cowl 10 may include an elastic member that seals the gap between the bottom cowl 11 and the top cowl 12.

The cowl 10 may include, instead of the right clamp device 14, a mechanism that locks the front end portion of the top cowl 12 and the bottom cowl 11.

The left clamp device 13 may be disposed on the top cowl 12. In this case, it is only required to fix the fixed member 85 to the bottom cowl 11.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine; and a cowl housing the engine; wherein the cowl includes:

a bottom cowl that opens upward;

a top cowl that opens downward, the top cowl closing an opening of the bottom cowl; and a clamp device that detachably couples the top cowl to the bottom cowl;

the clamp device includes:

a clamp disposed inside the cowl; and an operating lever that operates the clamp, the operating lever being disposed outside the cowl; wherein a mating portion is located between the bottom cowl and the top cowl and includes a first mating section and a second mating section as seen in a side view of the cowl, the first mating section extending rearward from a front end portion of the cowl, and the second mating section extending upward and rearward from a rear end of the first mating section;

the operating lever is located above an extension line defined by extending the first mating section rearward as seen in the side view of the cowl;

the operating lever is housed in a recess provided on an outer surface of the cowl; and a portion of an outer edge of an opening of the recess extends along the second mating section.

2. An outboard motor comprising:

an engine; and a cowl housing the engine; wherein the cowl includes:

a bottom cowl that opens upward;

a top cowl that opens downward, the top cowl closing an opening of the bottom cowl; and a clamp device that detachably couples the top cowl to the bottom cowl;

the clamp device includes:

a clamp disposed inside the cowl; and an operating lever that operates the clamp, the operating lever being disposed outside the cowl; wherein a mating portion is located between the bottom cowl and the top cowl and includes a first mating section and a second mating section as seen in a side view of the cowl, the first mating section extending rearward from a front end portion of the cowl, and the second mating section extending upward and rearward from a rear end of the first mating section;

the operating lever is located above an extension line defined by extending the first mating section rearward as seen in the side view of the cowl;

the clamp includes a fixed member, an engaging member, and a turn shaft, the engaging member is able to be engaged with the fixed member, and the turn shaft couples the engaging member and the operating lever;

the operating lever includes a fixing portion and a holding portion, the fixing portion is fixed to the turn shaft, and the holding portion is located rearward of the turn shaft;

the operating lever is turnable about the turn shaft to an engaged position in which the engaging member is engaged with the fixed member and a released position in which the engaging member is released from the fixed member; and the released position is located above the engaged position.

3. The outboard motor according to claim 2, wherein the turn shaft extends in a horizontal or substantially horizontal direction.

4. The outboard motor according to claim 3, wherein the engaging member is moved along an inner surface of the cowl when the engaging member is turned about the turn shaft.

5. The outboard motor according to claim 2, wherein
the cowl includes a recess housing the operating lever;
the engaged position includes a housed position in which the operating lever is housed in the recess and a protruded position in which at least a portion of the operating lever protrudes from the recess;
the operating lever is turnable about the turn shaft from the protruded position to the released position; and
the operating lever is supported by a support disposed in the recess when the operating lever is turned from the protruded position to the released position.

6. The outboard motor according to claim 5, wherein a center of gravity of the operating lever is located above and forward of the turn shaft when the operating lever is turned from the protruded position to the released position.

7. The outboard motor according to claim 2, wherein the operating lever is housed in a recess provided on an outer surface of the cowl.

8. The outboard motor according to claim 7, wherein a portion of an outer edge of the recess extends along the second mating section.

9. The outboard motor according to claim 7, wherein the operating lever is movable to a housed position in which the operating lever is housed in the recess and a protruded position in which at least a portion of the operating lever protrudes outside the recess.

10. The outboard motor according to claim 2, wherein the operating lever is disposed on an outside of the bottom cowl.

11. The outboard motor according to claim 1, wherein
the clamp includes a fixed member, an engaging member, and a turn shaft, the engaging member is able to be engaged with the fixed member, and the turn shaft couples the engaging member and the operating lever;
the operating lever includes a fixing portion and a holding portion, the fixing portion is fixed to the turn shaft, and the holding portion is located rearward of the turn shaft;
the operating lever is turnable about the turn shaft to an engaged position in which the engaging member is engaged with the fixed member and a released position in which the engaging member is released from the fixed member; and
the released position is located above the engaged position.

12. The outboard motor according to claim 11, wherein the turn shaft extends in a horizontal or substantially horizontal direction.

13. The outboard motor according to claim 12, wherein the engaging member is moved along an inner surface of the cowl when the engaging member is turned about the turn shaft.

14. The outboard motor according to claim 11, wherein
the engaged position includes a housed position in which the operating lever is housed in the recess and a protruded position in which at least a portion of the operating lever protrudes from the recess;
the operating lever is turnable about the turn shaft from the protruded position to the released position; and
the operating lever is supported by a support disposed in the recess when the operating lever is turned from the protruded position to the released position.

15. The outboard motor according to claim 14, wherein a center of gravity of the operating lever is located above and forward of the turn shaft when the operating lever is turned from the protruded position to the released position.

16. The outboard motor according to claim 1, wherein the operating lever is movable to a housed position in which the operating lever is housed in the recess and a protruded position in which at least a portion of the operating lever protrudes outside the recess.

17. The outboard motor according to claim 1, wherein the operating lever is disposed outside the bottom cowl.

18. An outboard motor comprising:
an engine; and
a cowl housing the engine; wherein
the cowl includes:
a bottom cowl that opens upward;
a top cowl that opens downward, the top cowl closing an opening of the bottom cowl; and
a clamp device that detachably couples the top cowl to the bottom cowl;
the clamp device includes:
a clamp disposed inside the cowl; and
an operating lever that operates the clamp, the operating lever being disposed outside the cowl; wherein
a mating portion is located between the bottom cowl and the top cowl and includes a first mating section and a second mating section as seen in a side view of the cowl, the first mating section extending rearward from a front end portion of the cowl, and the second mating section extending upward and rearward from a rear end of the first mating section;
the operating lever is located above an extension line defined by extending the first mating section rearward as seen in the side view of the cowl;
the operating lever is disposed outside the bottom cowl.

19. The outboard motor according to claim 18, wherein
the clamp includes a fixed member, an engaging member, and a turn shaft, the engaging member is able to be engaged with the fixed member, and the turn shaft couples the engaging member and the operating lever;
the operating lever includes a fixing portion and a holding portion, the fixing portion is fixed to the turn shaft, and the holding portion is located rearward of the turn shaft;
the operating lever is turnable about the turn shaft to an engaged position in which the engaging member is engaged with the fixed member and a released position in which the engaging member is released from the fixed member; and
the released position is located above the engaged position.

20. The outboard motor according to claim 19, wherein the turn shaft extends in a horizontal or substantially horizontal direction.

21. The outboard motor according to claim 20, wherein the engaging member is moved along an inner surface of the cowl when the engaging member is turned about the turn shaft.

22. The outboard motor according to claim 19, wherein
the cowl includes a recess housing the operating lever;
the engaged position includes a housed position in which the operating lever is housed in the recess and a protruded position in which at least a portion of the operating lever protrudes from the recess;
the operating lever is turnable about the turn shaft from the protruded position to the released position; and the operating lever is supported by a support disposed in the recess when the operating lever is turned from the protruded position to the released position.

23. The outboard motor according to claim 22, wherein a center of gravity of the operating lever is located above and forward of the turn shaft when the operating lever is turned from the protruded position to the released position.

24. The outboard motor according to claim 18, wherein the operating lever is housed in a recess provided on an outer surface of the cowl.

25. The outboard motor according to claim 24, wherein a portion of an outer edge of the recess extends along the second mating section.

26. The outboard motor according to claim 24, wherein the operating lever is movable to a housed position in which the operating lever is housed in the recess and a protruded position in which at least a portion of the operating lever protrudes outside the recess.

* * * * *